US005338038A

United States Patent [19]

Cadorniga

[11] Patent Number: 5,338,038

[45] Date of Patent: Aug. 16, 1994

[54] GOLF BALL

[75] Inventor: Lauro C. Cadorniga, Piedmont, S.C.

[73] Assignee: Dunlop Slazenger Corporation, Greenville, S.C.

[21] Appl. No.: 54,415

[22] Filed: Apr. 28, 1993

[51] Int. Cl.[5] ..... A63B 37/08; A63B 37/12; A63B 37/06

[52] U.S. Cl. ..... 273/216; 273/225; 273/227; 273/231; 273/235 R; 273/232

[58] Field of Search ..... 273/216, 232, 220, 225, 273/227, 231, 235 R

[56] References Cited

U.S. PATENT DOCUMENTS

| | | | |
|---|---|---|---|
| 3,848,480 | 11/1974 | Oseroff et al. | 273/81.5 |
| 3,950,838 | 4/1976 | Oseroff et al. | 273/81.5 X |
| 4,986,545 | 1/1991 | Sullivan | 273/235 R |
| 5,019,319 | 5/1991 | Nakamura et al. | 273/220 X |
| 5,098,105 | 3/1992 | Sullivan | 273/235 R |
| 5,120,791 | 6/1992 | Sullivan | 273/235 R X |
| 5,187,013 | 2/1993 | Sullivan | 273/235 R X |

*Primary Examiner*—George J. Marlo
*Attorney, Agent, or Firm*—Lorusso & Loud

[57] ABSTRACT

A golf ball comprising:

a center portion including an elastomeric envelope normally of substantially spherical configuration, of Shore A durometer hardness of 40–50, and of a wall thickness of 0.085–0.095 inch, and a paste filling fully occupying said envelope, said paste filling having a viscosity of at least 100,000 centipoise.

a thread wound portion including an elastomeric thread wound upon said envelope, said thread having an elongation of 1,238% (±150%), a tensile strength of 3,056 (±500) p.s.i., and a cross-sectional rectangular configuration of a size of 0.0625 (±0.002)×0.012−0.018 inch, a cover portion of a thermoplastic material having a density of 1.00–1.04 g/cm$^3$, a flexural modulus of 5,000–10,000 p.s.i. and a Shore D Durometer hardness of 42–52, and a plurality of dimples therein, said dimples occupying 70–80% of the surface area of said ball, and said dimples having a total volume of 415–445 mm$^3$, said ball having a diameter of 1.680–1.688 inches, a weight of 44.5–45.93 g, and a density of 1.090–1.113 g/cm$^3$.

27 Claims, 6 Drawing Sheets

FIG. 3

TOTAL DISTANCE

DRIVER

| TEST | NEW BALL DISTANCE (YARDS) | BALATA BALL DISTANCE (YARDS) | NEW BALL ADVANTAGE (YARDS) |
|---|---|---|---|
| 1 | 257.2 | 255.9 | 1.3 |
| 2 | 255.4 | 253.8 | 1.6 |
| 3 | 290.6 | 287.8 | 2.8 |
| 4 | 286.1 | 284.0 | 2.1 |
| 5 | 278.1 | 277.5 | 0.6 |
| 6 | 281.6 | 279.7 | 1.9 |
| 7 | 278.3 | 273.1 | 5.2 |
| 8 | 268.2 | 264.6 | 3.6 |
| 9 | 257.2 | 255.9 | 1.3 |
| 10 | 255.4 | 253.8 | 1.6 |
| 11 | 281.6 | 279.7 | 1.9 |
| 12 | 290.6 | 287.8 | 2.8 |
| 13 | 286.1 | 284.0 | 2.1 |
| 14 | 278.1 | 277.5 | 0.6 |
| 15 | 257.6 | 256.6 | 1.0 |
| 16 | 264.7 | 261.8 | 2.9 |
| AVG: | 272.9 yards | 270.8 yards | 2.1 yards |

FIG. 4

TOTAL DISTANCE

5 IRON

| TEST | NEW BALL DISTANCE (YARDS) | BALATA BALL DISTANCE (YARDS) | NEW BALL ADVANTAGE (YARDS) |
|---|---|---|---|
| 1 | 179.2 | 180.9 | -1.7 |
| 2 | 164.2 | 162.7 | 1.5 |
| 3 | 170.0 | 168.7 | 1.3 |
| 4 | 172.7 | 175.9 | -3.2 |
| 5 | 164.2 | 162.7 | 1.5 |
| 6 | 170.0 | 168.7 | 1.3 |
| AVG: | 170.1 yards | 169.9 yards | 0.2 yard |

GOLF BALL

BACKGROUND OF THE INVENTION

1. Field of the Invention

The invention relates to golf balls and is directed more particularly to an inexpensive golf ball adapted substantially to duplicate the performance of more expensive golf balls.

2. Description of the Prior Art

Balata covered golf balls are known for their many advantages from a performance standpoint. The Balata balls are known for exercising more spin than other balls and therefore afford excellent control. The Balata balls, upon impact, exhibit greater resilience than other balls, which resilience contributes to the control exercised by the player over the ball. Still further enhancements are the "feel" of the ball upon impact and the audible "click" emanating from the ball upon impact. In view thereof, from a performance standpoint the Balata-covered ball is the preferred ball by most top-level players.

Unfortunately, the Balata-covered ball is expensive to manufacture and is easily deformed, as by cutting. The Balata itself is derived from the sap of tropical American trees of the sapodilla family, most notably manilkana bidentata and hevea brazilientis. The sap is dried and extensively processed to render the sap suitable for golf balls. Such processing is labor-intensive and involves the use of toxic chemicals in cleaning and curing of the substance. Inasmuch as the completed ball will not take paint well, the ball must be treated through chlorination to provide a white color appearance. As a result of the labor involved, and the extraordinary steps required for storage, use, and disposal of toxic chemicals, the Balata ball necessarily carries a heavy price tag.

Attempts have been made to replace the Balata with a urethane cover. However, the urethane very quickly loses resilience and performance suffers markedly.

Accordingly, there is a need for a ball having the "feel", "click", and performance of Balata covered balls, the performance including characteristics of resiliency, spin, and control equivalent to the Balata covered balls, the ball being susceptible to relatively inexpensive manufacture, and resistant to cutting or other deformation.

SUMMARY OF THE INVENTION

It is, therefore, an object of the invention to provide a golf ball having the favorable characteristics of the Balata-covered ball, but susceptible to inexpensive manufacture and resistant to cutting and other deformation.

With the above and other objects in view, as will hereinafter appear, a feature of the present invention is the provision of a golf ball comprising a center portion including an elastomeric envelope normally of spherical configuration and of a selected hardness and wall thickness, and a paste filling the envelope, the paste having a selected viscosity, an elastomeric thread wound upon the envelope, the thread being of a selected size and tensile strength, and a cover portion of thermoplastic of a selected density, flexural modulus, and durometer hardness, the cover portion having dimples therein occupying 70–80% of the surface area of the ball and having a total volume of 415–445 $mm^3$, the ball having a selected size, weight, and density.

The above and other features of the invention, including various novel details of construction and combinations of elements, will now be more particularly described with reference to the accompanying drawings and pointed out in the claims. It will be understood that the particular device embodying the invention is shown by way of illustration only and not as a limitation of the invention. The principles and features of the invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings:

FIG. 3 is a chart showing comparative distances for the ball of FIG. 1 and a prior art ball, when hit by a driver;

FIG. 4 is a chart similar to FIG. 3, but showing comparative distances for the ball of FIG. 1 and the prior art ball, when hit by a 5 iron;

DESCRIPTION OF THE PREFERRED EMBODIMENTS

Figure 1:
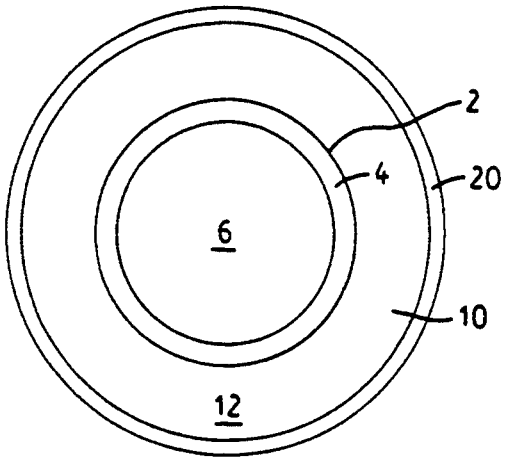
FIG. 1 is a diagrammatic center-line cross-sectional view of one form of golf ball illustrative of an embodiment of the invention.
Figure 2:
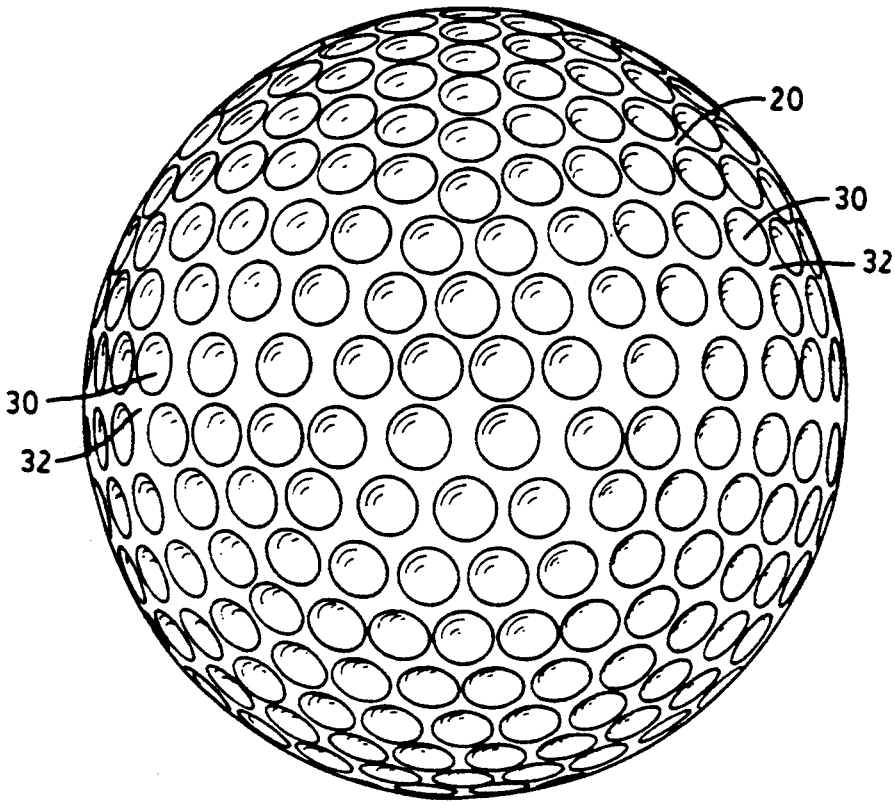
FIG. 2 is a side elevational view of the golf ball of FIG. 1.

Referring to FIG. 1, it will be seen that the illustrative embodiment includes a center portion 2, including an elastomeric envelope 4 and a paste filling 6 which completely fills the envelope 4.

The envelope 4 is of an elastomeric material, such as rubber. The envelope 4 is normally of a spherical configuration and has a wall thickness of 0.085–0.095 inch. The envelope 4 is of a weight of 10.0–10.6 grams (g), which comprises about 22.5–22.9% of the weight of the ball. The envelope is of a Shore A durometer hardness of 40–50 and of a density of 2.2–2.3 grams per cubic centimeter ($g/cm^3$). The resilience of the elastomeric envelope is no less than 50%, as determined by resiliometer tests known in the industry.

In a preferred embodiment, the envelope is of rubber, is out-of-round by no more than 0.015 inch, has a weight of 10.3 g, a wall thickness off 0.09 inch, a Shore A durometer hardness of 45, a density of 2.25 $g/cm^3$, and a resilience of 55%.

Thus, the envelope 4 is as soft as possible and yet can be processed to form half shells which are molded together, encapsulating the paste filling 6, and cured. The envelope of soft and thin rubber walls contributes to a softer "feel" in use of the ball.

The paste filling 6 is a soft paste, having a viscosity of at least 100,000 centipoise (cps). The weight of the paste filling 6 is 6.0–6.4 g, which comprises about 13.5–13.9% of the weight of the ball. The viscosity of 100,000 or more cps contributes to the desired spin rate. Lesser viscosities lead to excessive spin which deleteriously affects flight distance, or range. The paste filling 6 is of a density of 1.01–1.05 g/cm$^3$.

In the above-referred to preferred embodiment, the paste filling 6 is of a viscosity of 150,000 cps, a weight of 6.2 g, and a density of 1.03 g/cm$^3$.

The soft paste filling 6 may be a homogeneous solution of water and polyethylene oxide. The solution does not separate out under atmospheric conditions.

The paste filled envelope 4 provides the ball center portion 2 , which is of a diameter of 1.07–1.11 inch, a weight of 16.0–17.0 g, and a Shore A durometer surface hardness of 40–50. The center portion has a density of 1.60–1.63 g/cm$^3$. The center portion 2 as described hereinabove, exhibits a rebound factor, as determined by drop-rebound tests, known in the industry, of 30–40%, and a 10 mm deflection factor of 2.25–2.75 kilograms (kg). The latter factor relates to the load on the ball center required to compress the ball to a height of 10 mm. The ball center is structured for durability under playing conditions. A durability test used in the industry is to place a 50 lb. weight on the ball center for 5 seconds and observe leakage. The center described herein was so tested and no leakage observed.

In the above-mentioned preferred embodiment, the center portion 2 is of a diameter of 1.09 inch, a weight of 16.5 g, a Shore A durometer hardness of 45, and a density of 1.615 g/cm$^3$. The center portion 2 is out of round by no more than 0.015 inch. The structure produced a ball center having a 35% rebound factor and a 10 mm deflection factor of 2.5 kg.

Upon the center portion 2 is disposed a thread-wound portion 10 comprising an elastomeric thread 12 of elongation, high tensile strength, and small cross-sectional size to provide the desired compression hardness and initial velocity. The thread 12 may be of rubber and preferably has an elongation factor of 1250% (±150%). The tensile strength of the thread 12 is 3,050 (±500) p.s.i. The thread 12 is substantially rectangular in cross-section, with a preferred size of 0.0625 (±0.002)×0.012−0.018 inch. The thread is provided with a density of 0.92–0.94 g/cm$^3$. The thread-wound portion 10 weighs about 19.0–19.6 g, which comprises about 42.7% of the weight of the ball. Tests well known in the art reveal that the thread described herein exhibits a 500% Modulus factor of 250 (±50) p.s.i. and a Schwartz Modulus of 200 (+50) p.s.i. Typically, about 120 feet of stretched thread is wound upon the center portion 2.

The thread 12 is compounded initially to produce high tensile strengths, then cut to thinner gauge to promote higher compression hardness. Typical prior art thread size is 0.625×0.020−0.024 inch which when applied to the present invention, yields a compression hardness of 65–80. A desirable compression range is 80–100. The thread size of 0.0625×0.012−0.018 inch has produced a compression hardness of 80–105. While lower thread size, that is, below 0.0625×0.012 inch, produces acceptable compression hardness, the processability is reduced; thread breakage may occur during the winding process.

Molded over the thread-wound portion 10 is a cover 20 of thermoplastic material which is relatively easy, and therefore inexpensive, to process. The cover is provided with a density directed toward affording a desirable spin rate. The thermoplastic material is selected to provide the desired "feel" and "click" as well as to add to initial velocity and to greatly improved durability.

More specifically, the cover material provided is of a density of 1.00–1.04 g/cm$^3$. The cover 20 weighs about 9.0–10.0 g, which constitutes about 20.2–21.8% of the weight of the ball. Generally, non-Balata covered balls have densities of less than 1.0 g/cm$^3$. To the thermoplastic cover material of the present invention, there is added a weight filler concentrate to raise the density to the above-mentioned range of 1.00–1.04 g/cm$^3$. Thermoplastic cover materials are traditionally of less than 1.0 g/cm$^3$ density. However addition of the weight filler makes possible the use of high density thermoplastic cover material, which facilitates attainment of the same weight distribution as is found in Balata covered balls, allowing the same level of radius of gyration, thereby obtaining the desired spin rate for control on approach shots to the green.

A color filler added to the thermoplastic further provides the desired color. The ball herein may be painted with one or more clear coat finishes. Typically, Balata covered balls require two coats of pigmented white paints to hide the Balata brownish-yellowish color, even after chlorination. Further, the timing of the application of the two coats is critical.

The thermoplastic cover material for the cover 20 is provided with flexural modulus of 5,000–10,000 p.s.i., essentially duplicating the balata cover, and a Shore D durometer hardness of 42–52. Such material contributes to the "feel" and "click" preferred by players. Further, the combination of softness in the cover 20 and the center portion 2 promotes the aforementioned desired spin rate performances needed on approach shots to the green.

In the aforementioned preferred embodiment, the cover 20 is provided with a density of 1.02 g/cm$^3$, a flexural modulus of 7,500 p.s.i., and a Shore D durometer hardness of 47.

Besides affording performance characteristics comparable to the Balata-covered ball, the cover material described herein above is susceptible to processing at low temperatures. In a known "melt flow index" test, which is essentially for processability, the thermoplastic cover material described herein registers about 1–4 grams per ten minutes. Thus, time may be taken to permit the thermoplastic, in molding, to penetrate well into the thread, eliminating any voids therein. In high temperature molding operations, wherein temperatures exceed 300° F., the thread suffers structurally after only 3–5 minutes. The penetration of the cover portion 20 into the thread wound portion 10 contributes to durability of the ball.

Other characteristics of the cover 20, as determined by known tests, include a tensile yield of 500–1,000 p.s.i., a tensile break of 2,750–4,250 p.s.i., and an elongation break of 500–650%.

In the preferred embodiment noted hereinabove, the melt flow index is 1.8 grams/10 mins., the tensile yield is 750 p.s.i., the tensile break is 3,500 p.s.i., and the elongation break is 575%.

Finally, in tests known in the industry for torsional modulus, the following moduli were noted:

| TEMP °F. | p.s.i. |
|---|---|
| 32 | 5,000–9,000 |
| 50 | 3,000–6,000 |
| 77 | 1,500–3,500 |
| 86 | 600–1,800 |

The above results are comparable to balata properties. Typical thermoplastic materials yield very high torsional modulus at lower temperatures and low torsional modulus at high temperatures.

The cover portion 20 is molded so as to form a number of dimples 30 in the surface 32 of the ball. Dimples of various configurations and arrangements are well known in the art. It has been found that in combination with the above-described elements, the dimple topography for yielding the optimum flight distance performances includes a dimple volume of 415–445 $mm^3$ and a dimple surface area of 70%–80% of the area of the ball surface 32. The dimples 30 on a ball may include dimples of different diameter sizes and different depths, as is known in the art.

In the above-mentioned preferred embodiment, the ball is provided with 432 dimples in an icosadodecahedron pattern, the dimples occupying about 75% of the surface area of the ball and having a total volume of about 430 $mm^3$.

The above-described components cooperatively define a ball having a diameter of 1.680–1.688 inches and a weight of 44.5–45.93 g, both parameters within the requirements for a USGA conforming golf ball. The density of the ball is 1.090–1.113 $g/cm^3$. The ball exhibits a rebound factor of 70–80%, in accordance with rebound tests known in the art. The initial velocity of the ball is 252–255 ft/sec. when tested in accordance with applicable USGA test methods (methods filed at the USGA Test Center). The initial velocity is less with a lesser club head speed and greater with increased club head speed. In accordance with tests known in the industry, the "impact deformation" of the above-described ball, at 0°–35° C. is 1.0 inch or greater, substantially the same as a standard Balata-covered ball.

One of the features of the Balata-covered ball most attractive to high-level players, is the spin rate of the ball. Balata balls spin at a higher rate than other balls and the high rate of spin provides for better control of the ball. The rate of spin is determined by a strobe light test known in the industry. In comparison tests between the preferred embodiment of the ball noted above, and a standard Balata-covered ball (known as a "Maxfli HT" ball), the spin rate of the ball described hereinabove exceeded the spin rate of the Balata-covered ball by 200 r.p.m. when machine-tested with a driver, 500 r.p.m. when machine-tested with a 5 iron, and 750 r.p.m. when machine-tested with a pitching wedge. Thus, in the area of spin rate capability, the ball of the present invention actually exceeds the HT Balata-covered ball, providing a very desirable characteristic.

The combination of elements, as described above, provides a ball which substantially duplicates or improves upon the desirable properties of the Balata-covered ball, while overcoming the expense and lack of durability associated with the Balata balls.

Tests have been run by both machines and human players, wherein balls constructed as described above have been compared with Balata-covered balls. There now follow brief descriptions of those tests.

Referring to FIGS. 3 and 4, it will be seen that in machine testing the ball described herein ("new ball"), in tests conducted with a driver, the new ball out-performed the Balata ball by about two yards, while in tests conducted with a 5 iron, the new ball and Balata ball were about even. The tests were conducted with a "True Temper" machine and a "Robo Shot III" machine, both well known in the industry.

Figure 5:
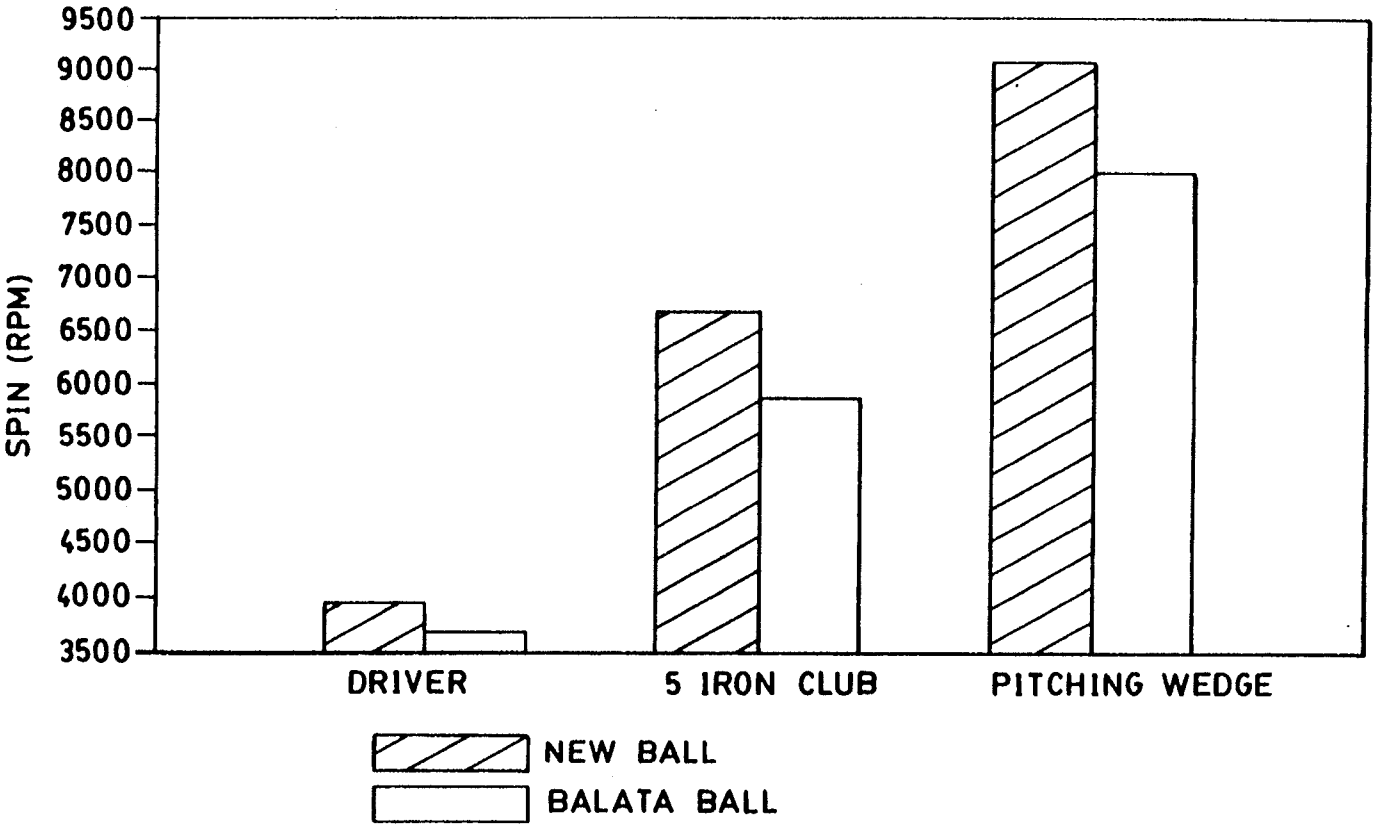
FIG. 5 is a chart depicting comparative spin rates of the ball of FIG. 1 and the prior art ball when hit with any of a driver, 5 iron and pitching wedge.

In FIG. 5, a comparison of the spin rates of the new ball and the Maxfli HT Balata Ball is shown relative to drivers, 5 irons and pitching wedges. In each instance, the new ball exhibits a substantially higher spin rate than does the Balata ball.

Figure 6:
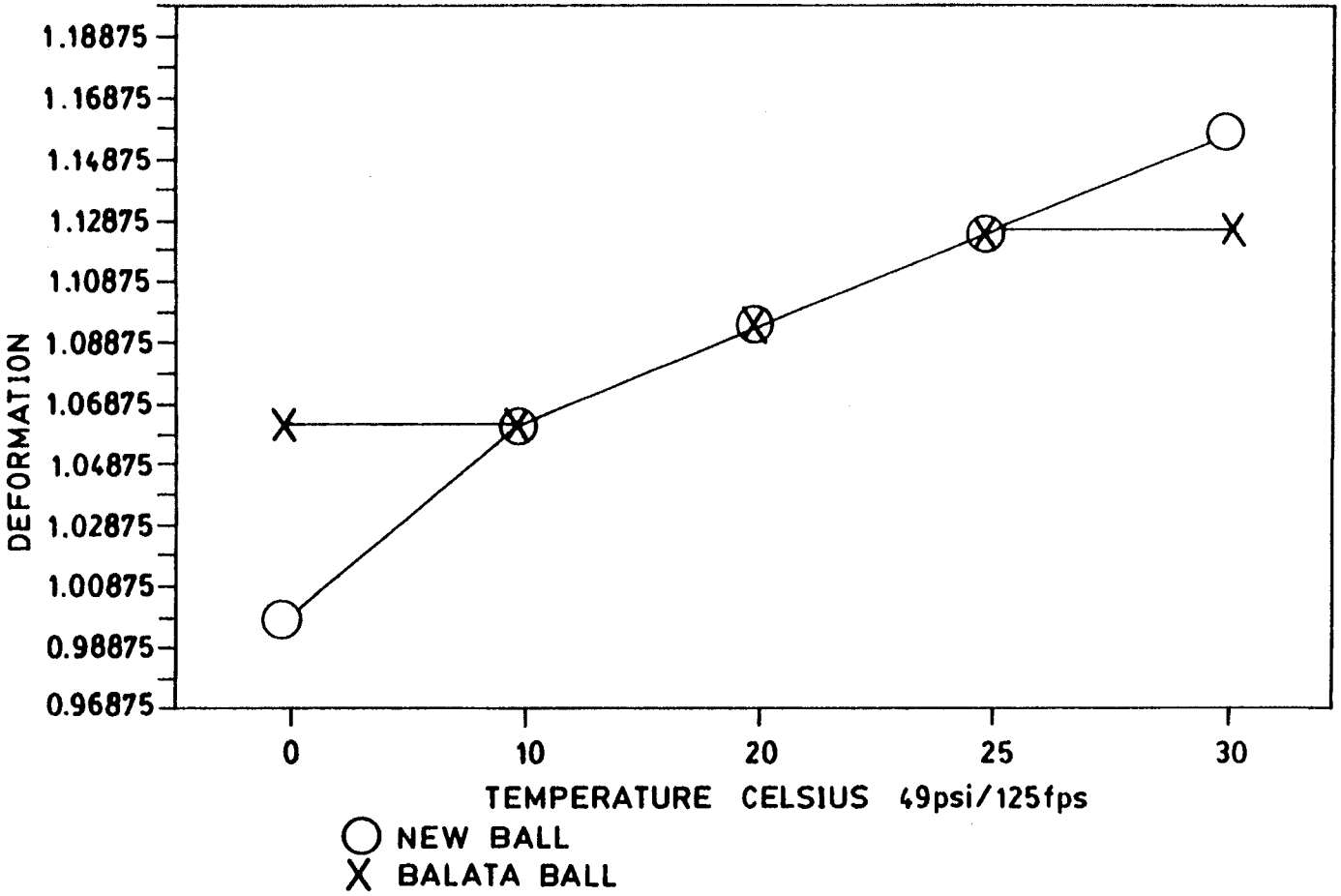
FIG. 6 is a chart illustrating comparative ball deformation factors for the ball of FIG. 1 and the prior art ball.
Figure 7:
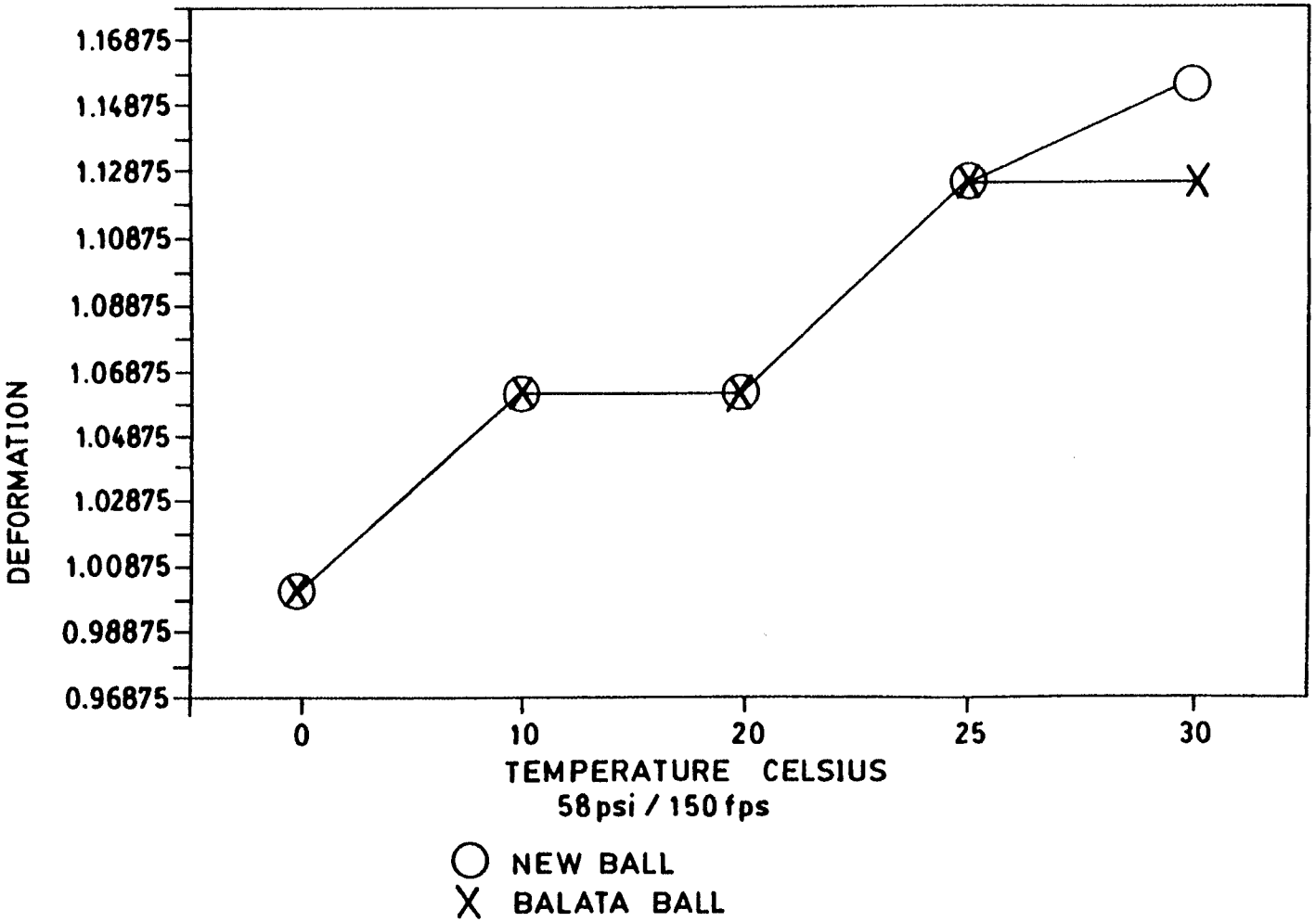
FIG. 7 is similar to FIG. 6, but illustrating the ball deformation factor for the ball of FIG. 1 and the prior art ball when hit harder than illustrated in FIG. 6.

In FIGS. 6 and 7, there are compared the deformation factors for the new ball and the Maxfli HT Balata Ball. In FIG. 6, the deformation test is conducted with ball propulsion initiated by a pressure of 49 p.s.i., which propels the ball at about 125 feet per second against a flat rigid plate. Upon striking the plate, which in the test is covered with a carbon paper sheet, the deformation of the ball makes a generally circular carbon trace on the plate. The diameter of the circular carbon trace is known as the "deformation" of the ball. As may be seen in FIG. 6, at 0° C. the deformation of the new ball and the Balata ball is different, and at above 25° C., the deformation of the Balata ball levels off, while the deformation of the new ball continues to increase. From 10°–25° C., the two balls exhibit substantially equal deformations. When the velocity of the propelled ball is increased to 150 f.p.s., the two balls exhibit substantially equal deformation from 0° C. to 25° C. Again, above 25° C., the Balata ball deformation levels off, while the new ball deformation increases.

Thus, machine tests have indicated that the new ball provides better driving distance than the Balata ball and essentially equal 5 iron distance, improved spin rate performance for drivers, 5 irons and pitching wedges, and deformation characteristics about the same or better than the Balata ball.

In "live golfer" tests, eight professional level players tested the new ball against the Maxfli HT Balata Ball. The eight players averaged two yards longer on drivers with the new ball. Six of the eight players hit their longest drive with the new ball. One player hit his longest drive with the HT ball. One player hit equally long drives with the two balls. With the 5-iron, four players hit their longest shots with the new ball and four players hit their longest shots with the HT ball. On average, the HT shots with the 5 iron exceeded the new ball shots with the 5 iron by about one yard. Accordingly, the "live golfer" tests substantially duplicated the results of the machine tests for distance.

Overall, the players could not detect any difference between the two balls. They were deemed the same in "click" and "feel", as well as performance. One of the players developed a preference for the new ball, but seven of the players developed no preference.

In subsequent "live golfer" tests, involving an additional nine players and including less extensive testing of the 3 wood, 2 iron, 4 iron, 6 iron and 8 iron, similar results were obtained. The comments uniformly have been that the two balls are equal in performance and in feel and click. All seventeen players involved in the "live" tests indicated they would play the new ball to obtain the traditional Balata ball feel, click and performance.

It is to be understood that the present invention is by no means limited to the particular construction herein disclosed and/or shown in the drawings, but also comprises any modifications or equivalents within the scope of the claims.

Having thus described my invention, what I claim as new and desire to secure by Letters Patent of the United States is:

1. A golf ball comprising:

a center portion including an elastomeric envelope normally of substantially spherical configuration, of Shore A durometer hardness of 40–50, and of a wall thickness of 0.085–0.095 inch, and a paste filling fully occupying said envelope, said paste filling having a viscosity of at least 100,000 centipoise, a thread wound portion including an elastomeric thread wound upon said envelope, said thread having an elongation of 1238% (±150%), a tensile strength of 3,056 (±500) p.s.i., and a cross-sectional rectangular configuration of a size of 0.0625 (±0.002)×0.012–0.018 inch, a cover portion of a thermoplastic material having a density of 1.00–1.04 g/cm$^3$, a flexural modulus of 5,000–10,000 p.s.i., and a Shore D durometer hardness of 42–52, and a plurality of dimples therein, said dimples occupying 70–80% of the surface area of said ball, and said dimples having a total volume of 415–445 mm$^3$, said ball having a diameter of 1.680–1.688 inches, a weight of 44.5–45.93 g, and a density of 1.090–1.113 g/cm$^3$.

2. The golf ball in accordance with claim 1, wherein said elastomeric envelope weighs 10.0–10.6 g and has a density of 2.2–2.3 g/cm$^3$.

3. The golf ball in accordance with claim 2 wherein said weight of said envelope comprises about 22.5–22.9% of the weight of said ball.

4. The golf ball in accordance with claim 3 wherein said envelope is of a thickness of 0.085–0.095 inch and has a Shore A hardness of 40–50.

5. The golf ball in accordance with claim 4 wherein said center portion elastomeric envelope is of rubber providing a resiliometer reading of 50% or greater.

6. The golf ball in accordance with claim 5 wherein said rubber envelope weight is about 10.3 g, said rubber envelope density is about 2.25 g/cm$^3$, said rubber envelope Shore A hardness is about 45, said rubber envelope thickness is about 0.090 inch, and said rubber envelope resiliometer reading is about 55.

7. The golf ball in accordance with claim 1 wherein said paste filling weighs 6.0–6.4 g and has a density of 1.01–1.05 g/cm$^3$.

8. The golf ball in accordance with claim 7 wherein said weight of said paste filling comprises about 13.5–13.9% of the weight of said ball.

9. The golf ball in accordance with claim 8 wherein said center portion paste has a weight of about 6.2 g and a density of about 1.03 g/cm$^3$.

10. The golf ball in accordance with claim 1 wherein said center portion is provided with a diameter of 1.07–1.11 inch.

11. The golf ball in accordance with claim 10 wherein said center portion is provided with a diameter of about 1.09 inch.

12. The golf ball in accordance with claim 10 wherein said center portion has a density of about 1.615 g/cm$^3$.

13. The golf ball in accordance with claim 1 wherein said elastomer thread weighs about 19.0–19.6 g and has a density of 0.92–0.94 g/cm$^3$.

14. The golf ball in accordance with claim 13 wherein said elastomer thread is of rubber.

15. The golf ball in accordance with claim 14 wherein said rubber thread has a tensile strength of 3050 (±500) p.s.i.

16. The golf ball in accordance with claim 14 wherein the percentage elongation of said thread is 1250 (±150).

17. The golf ball in accordance with claim 14 wherein said thread has a Schwartz Modulus of 200 (±50) p.s.i., and a 500% Modulus of 250 (±50) p.s.i.

18. The golf ball in accordance with claim 14 wherein said thread is rectangular in cross-sectional configuration and of a size of about 0.625 (±0.002)×0.012–0.018 inch 19. The golf ball in accordance with claim 13 wherein said density of said thread is about 0.93 g/cm$^3$.

20. The golf ball in accordance with claim 13 wherein said weight of said elastomer thread comprises about 42.7% of the weight of said ball.

21. The golf ball in accordance with claim 1 wherein said cover material is provided with a tensile yield of 500–1,000 p.s.i. and a tensile break of 2,750–4,250 p.s.i.

22. The golf ball in accordance with claim 21 wherein said cover material is provided with break elongation of 500–650%.

23. The golf ball in accordance with claim 1 wherein said cover portion is provided with a specific gravity of about 1.02 g/cm$^3$, a Shore D hardness of about 47, a tensile yield of about 750 p.s.i., a tensile break of about 3,500 p.s.i. and break elongation of about 575%.

24. The golf ball in accordance with claim 23 wherein said cover portion is provided with a flexural modulus of about 7,500 p.s.i.

25. The golf ball in accordance with claim 1 wherein said cover portion weighs about 9.0–10.0 g and comprises about 20.2–21.8% of the weight of said ball.

26. The golf ball in accordance with claim 1 wherein said ball has a rebound factor of 70–80%

27. The golf ball in accordance with claim 1 wherein said center portion weighs 36.0–36.8% of the total weight of said ball, said thread wound portion weighs about 42.7% of said total weight, and said cover portion weighs 20.2–21.8% of said total weight.

* * * * *